United States Patent [19]

Werner, Jr.

[11] Patent Number: 4,484,683

[45] Date of Patent: Nov. 27, 1984

[54] RECLOSABLE CARTON

[75] Inventor: August C. Werner, Jr., St. Louis, Mo.

[73] Assignee: Ralston Purina Company, St. Louis, Mo.

[21] Appl. No.: 349,956

[22] Filed: Feb. 19, 1982

[51] Int. Cl.[3] ..... B65D 5/54

[52] U.S. Cl. ..... 206/624; 206/634; 229/17 R

[58] Field of Search ..... 206/621, 622, 624, 626, 206/633, 634, 625, 628; 229/41 R, 44 R, 38 R, 44 CB, 55, 17 R

[56] References Cited

U.S. PATENT DOCUMENTS

| | | | |
|---|---|---|---|
| 1,242,534 | 10/1917 | Eaton | 229/38 |
| 1,743,681 | 1/1930 | Neuman | 229/41 R |
| 2,002,364 | 5/1935 | Daller | 206/622 |
| 2,007,520 | 7/1935 | Daller | 206/622 |
| 2,015,199 | 9/1935 | Sparks et al. | 229/55 |
| 2,178,730 | 11/1939 | Stein | 206/624 |
| 2,292,653 | 8/1942 | Palmer | 229/14 |
| 2,345,486 | 3/1944 | Leebov | 229/44 R |
| 2,789,751 | 4/1957 | Feldman | 206/624 |
| 3,037,679 | 6/1962 | Metzger | 229/17 R |
| 3,071,304 | 1/1963 | Brastad | 229/14 |
| 3,128,934 | 4/1964 | Jacke | 229/14 |
| 3,272,423 | 9/1966 | Bjarno | 229/55 |
| 3,719,317 | 3/1973 | Brastad | 206/624 |
| 3,861,583 | 1/1975 | Tingley et al. | 206/626 |
| 4,042,110 | 8/1977 | Guernsey | 229/44 R |
| 4,211,267 | 7/1980 | Skovgaard | 229/55 |
| 4,228,898 | 10/1980 | Zeitter et al. | 206/621 |

*Primary Examiner*—Allan N. Shoap
*Assistant Examiner*—Bryon Gehman
*Attorney, Agent, or Firm*—Virgil B. Hill

[57] ABSTRACT

A reclosable carton which is easy to open and reseal is described comprising front and rear panels, connecting side panels with upper portions scored along vertical lines midway between the vertical edges of the side panels, a top flap for closure of the carton having an attached tab, wherein said tab and flap are secured to the side and rear panels by perforations to permit easy removal of the top flap with tab attached. A slot in the rear wall is provided to permit insertion of the tab upon reclosure of the carton which occurs when the top flap is folded along the common edge, created by the inward folding of the side panels along the vertical score lines of the side panel and the carton liner is folded over the top edge of the rear panel to reseal the liner and the carton.

3 Claims, 4 Drawing Figures

RECLOSABLE CARTON

BACKGROUND OF THE INVENTION

The present invention relates to a reclosable carton having a carton liner, which is easy to open and reseal in order to retain product freshness.

The packaging of consumer foods have long required a suitable container for consumer use that is easy to open as well as being capable of reclosure to retain product freshness. Prior art cartons for consumer products such as cereals and the like have employed rectangular cartons with a top panel consisting of two overlapping major flaps glued together with dust flaps or minor flaps set in an opposite direction to the major flaps wherein, a tuck tab is connected to one major flap which can be inserted into a slot in the other major flap to permit reclosure of the carton. The carton liner is separately refolded prior to closure of the major flaps to minimize product contaminations and retain freshness. The disadvantage of this type of carton relates primarily to the use of the glued together flaps which often do not separate cleanly therefore either destroying the tuck tab flap or slot and thereby eliminating the reclosure feature of the carton. Furthermore, the liner must be reclosed independently of the carton itself.

It would therefore be a distinct advantage to have a carton with a liner which can be easily opened by the consumer and yet be reclosable with minimal effort and effectively seal both the liner and carton.

SUMMARY OF THE INVENTION

This is achieved in the present invention by a reclosable carton which is not only easy to open but recloses in conjunction with the carton liner to provide a tighter seal upon closure of the package thereby retaining product freshness. Further, the use of a top flap having a tab secured thereto, said flap being secured to the front panel of the carton and connected to the rear wall by perforations, avoids the need for glue release patterns to secure the top flap and permits easy opening of the top flap by the consumer along the perforations without destruction of the tab.

Figure 1:
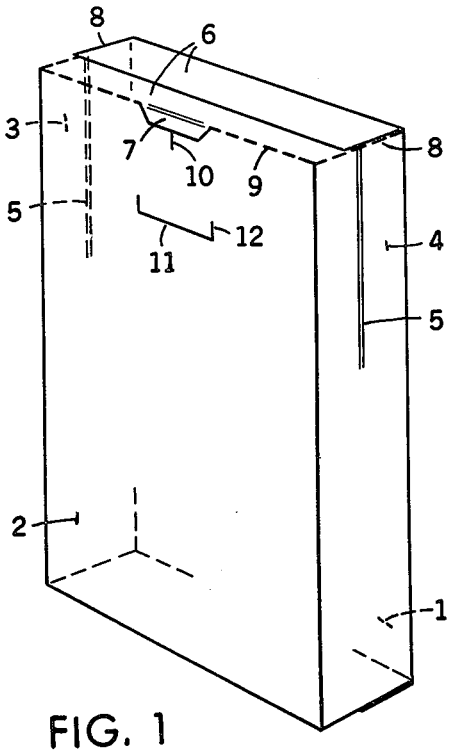
FIG. 1 is a perspective view showing the unopened carton.

The completed carton herein contemplated in unopened condition may be seen with reference to FIG. 1. The carton preferably comprises a rectangular shape to permit easy storage and multiple stacking of the cartons and comprises a front panel 1, a rear panel 2, connected by side panels 3 and 4. The upper portions of side panels 3 and 4 are stored along a vertical line 5 which is about midway between the vertical edges of the side panels. The score line 5 preferably extends from the top of the package in a vertical direction downwardly to a point that comprises a distance of about twice the distance between the vertical edges of the side panels 3 and 4. The carton includes a top flap 6, secured to the front panel 1 having a tab 7 secured to said flap. The top flap 6 is connected to the side panels 3 and 4 by perforations along lines 8 and connected to the rear panel 2 by perforations along line 9. The tab 7 which is part of the top flap 6 is secured to the rear panel 2, generally by perforations and preferably by die cuts or slots entirely through the rear panel 2 with tics of material between. This in combination with a die cut 10, which is perpendicular to line 9, permits the consumer to remove the entire top flap 6 from the carton by exerting pressure on the tab 7, generally at the point of the die cut 10 to separate the tab and then by exerting an upward pressure to separate the top flap from the carton. This allows the consumer to not only easily open the carton but the tab 7 is cleanly removed from the rear panel without damage and becomes part of the top flap. Rear panel 2 also includes a slot 11 created by perforations or a die cut or locking tab insert which consists not only of a horizontal cut 11 but optionally has vertical die cuts 12 at the edges of slot 11 to provide for easy opening of the insert or as a locking feature for tab 7 if the tab is somewhat larger upon reclosure of the carton as generally described below.

Figure 2:
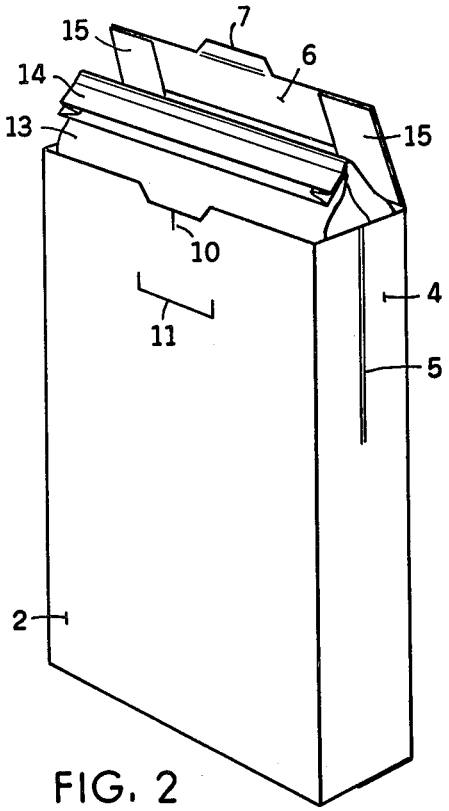
FIG. 2 is a perspective view showing the fully opened top of the carton with carton liner exposed.

With reference to FIG. 2, the carton with the top flap 6 completely open may be seen, thereby exposing the liner 13, which can typically by of any type of construction, material, or design for retention of product freshness during storage and may typically comprise a rectangular liner conforming to the shape of the carton with a fold over flap 14. The liner conforms to the shape of the carton when the carton is folded inwardly along score lines 5 and the top flap 6 with attached tab 7 is folded over the rear panel 2 for insertion in the tab slot 11. The flap 6 can comprise a single piece of material or preferably as shown in FIG. 2 a composite of overlapping major sections including dust flaps 15 which adjoin the top flap in an opposite direction to the overlapping sections. The use of the dust flaps 15 further reduces the chance for contamination of the carton during storage and increases the overall strength of the top flap 6, for purposes of continued resealing of the carton.

Figure 3:
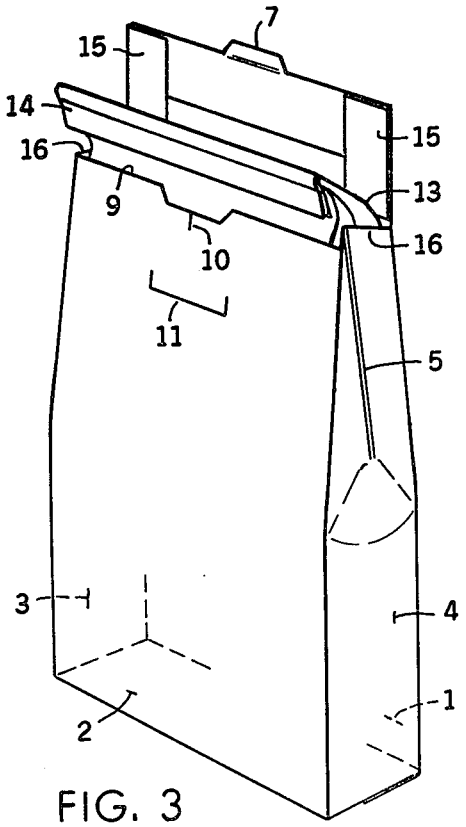
FIG. 3 is a perspective view showing the folded carton with fully opened top and reclosed carton liner.

FIG. 3 illustrates the carton in the initial step of reclosure, in which the side panels of the carton 3 and 4 are folded or creased inwardly along score lines 5 to permit the uppermost portions of front and rear panels 1 and 2 respectively to be brought together. Thereafter, the carton liner flap 14 may be folded towards the rear panel 2 rearwardly over the common edge formed by the top edge of the rear panel and the uppermost portions of the side panels or gussets 16 created by the inward folding of the side panels. The top flap 6 is then folded with the liner flap 14 simultaneously over the common edge so as to permit insertion of the tab 7 into the slot 11.

Figure 4:
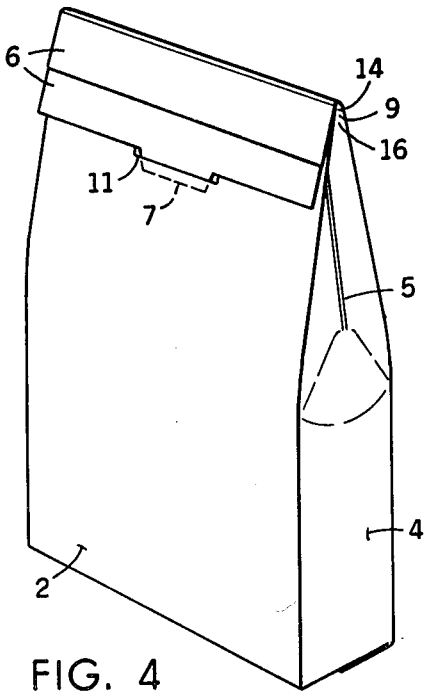
FIG. 4 is a perspective view showing the folded carton with reclosed liner and top flap fully reclosed.

The completely reclosed carton is illustrated in FIG. 4. Reclosure of the liner over the gussets 16 formed by the side panels and the rear panel provide an effective resealing of the carton and liner thereby significantly improving shelf life of the product therein. It is further apparent that the reclosable feature of the carton and liner of the present invention may be readily reused as often as required, until the container is empty.

While the invention has been described with reference to preferred embodiments, it will be understood by those skilled in the art that various changes may be made and equivalents may be substituted for elements thereof without departing from the true spirit and scope of the invention.

What is claimed is:

1. A reclosable carton and liner comprising: front and rear panels, connected by side panels whose upper portions are scored along vertical lines midway between the vertical edges of the side panels, a top closure flap secured to the front panel and connected to the side and rear panels with perforations, a tab secured to said flap which is connected to the rear wall by perforations, said rear wall having a perforated slot spaced axially downwardly from said tab, said carton having a liner with a fold over flap whereby upon closure of said carton, said side panels fold inwardly along said score lines to permit the uppermost portions of the side and rear panels to lie against one another and create a common edge with the top edge of the rear panel whereby the liner fold over flap is folded over the top edge of the rear panel and the flap of the carton is folded rearwardly over the common edge to permit insertion of the tab into the slot in the rear panel of the carton thereby resealing the carton and liner, wherein said rear panel has a die cut perpendicular to the line formed by connection of the tab to the rear panel to permit separation of the top flap from the carton by exerting pressure at the die cut to open the top of the flap and exerting an upward pressure to separate the top flap from the carton said die cut being spaced axially above and substantially apart from said perforated slot.

2. A reclosable carton and liner as set forth in claim 1 wherein said score lines on said side panels extend downwardly to a point that comprises a distance of about twice the distance between the vertical edges of the side panels.

3. A reclosable carton and liner as set forth in claim 1 wherein said top closure flap comprises overlapping sections parallel to the front and rear panels of said cartons with flaps attached thereto and parallel to the side panels.

* * * * *